US011603176B2

(12) United States Patent
King

(10) Patent No.: US 11,603,176 B2
(45) Date of Patent: Mar. 14, 2023

(54) BUOYANCY ADJUSTMENT DEVICE

(71) Applicant: Boxfish Research Limited, Remuera Auckland (NZ)

(72) Inventor: Benjamin Martin King, Waiheke Island (NZ)

(73) Assignee: BOXFISH RESEARCH LIMITED, Auckland (NZ)

( * ) Notice: Subject to any disclaimer, the term of this patent is extended or adjusted under 35 U.S.C. 154(b) by 0 days.

(21) Appl. No.: 17/288,404

(22) PCT Filed: Oct. 25, 2019

(86) PCT No.: PCT/NZ2019/050141

§ 371 (c)(1),
(2) Date: Apr. 23, 2021

(87) PCT Pub. No.: WO2020/085921

PCT Pub. Date: Apr. 30, 2020

(65) Prior Publication Data

US 2022/0289351 A1 Sep. 15, 2022

(30) Foreign Application Priority Data

Oct. 25, 2018 (NZ) ..... 747683

(51) Int. Cl.
*B63G 8/24* (2006.01)
*B63G 8/00* (2006.01)

(52) U.S. Cl.
CPC ..... *B63G 8/24* (2013.01); *B63G 2008/005* (2013.01)

(58) Field of Classification Search
CPC ... B63G 8/14; B63G 8/16; B63G 8/24; B63G 2008/005; B63B 2211/02
USPC ..... 114/312, 330, 331
See application file for complete search history.

(56) References Cited

U.S. PATENT DOCUMENTS

| | | | | |
|---|---|---|---|---|
| 2,436,646 | A | 2/1948 | Isabelle | |
| 2,487,090 | A | 11/1949 | Bamberger | |
| 3,605,670 | A | 9/1971 | Dzikowski | |
| 7,328,669 | B2 * | 2/2008 | Adams | B63C 11/46 114/274 |
| 2017/0174300 | A1 | 6/2017 | Moreno | |
| 2017/0369137 | A1 | 12/2017 | Smith et al. | |

FOREIGN PATENT DOCUMENTS

| | | | |
|---|---|---|---|
| CN | 106926997 | A | 7/2017 |

* cited by examiner

*Primary Examiner* — Daniel V Venne
(74) *Attorney, Agent, or Firm* — Finnegan, Henderson, Farabow, Garrett & Dunner, LLP

(57) ABSTRACT

A buoyancy adjusting device for an underwater device is described the device comprising: a tube having first and second ends; a resilient mechanism located at the first end of the tube and extending towards the second end of the tube; an opening near the second end of the tube; a catch at the second end of the tube; 5 and at least one block insertable into from the first end of the tube to adjust the buoyancy.

20 Claims, 5 Drawing Sheets

BUOYANCY ADJUSTMENT DEVICE

FIELD

This invention relates to a buoyancy adjustment device for underwater devices.

BACKGROUND

The present invention relates to a buoyancy adjustment device for underwater devices such as remotely operated vehicles or ROVs for use underwater, autonomous underwater vehicles or AUVs, drop cameras for use underwater and/or towed cameras for use underwater.

ROVs typically comprise a "submarine" unit or vehicle (vehicle), a top-side remote control unit (topside unit), and an umbilical cable connecting the two units together for transmitting control signals from the topside unit to the vehicle, and for transmitting information, video and signals from the vehicle to the topside unit. The umbilical cable may also transmit power for the vehicle or the vehicle may contain its own power source (batteries).

AUVs differ from ROVs in that they don't have an umbilical, always carry their own power source, and are instead programmed to accomplish a certain task on their own using sensors and/or position information. AUVs may communicate without a tether to the surface, but the amount of information that can be sent in either direction is limited.

The buoyancy of these various underwater devices needs to be adjusted for example depending on the water (fresh or salt), the device it is being used in or the accessories the device has attached. This adjustment is sometimes done with threaded rods onto which washers are added or removed and a nut is then threaded on to secure the washers to the rod. The requirement to remove and add a nut make it a fiddly task. This is especially so if for example eight buoyancy adjustment devices are used in the corners of a box shaped ROV/AUV. To add a washer to one corner the nut has to be removed, the washer added, and the nut replaced. To obtain neutral buoyancy this has to be repeated multiple times and in addition, the weight of the nut affects the buoyancy.

It is an object of the invention to provide a buoyancy adjustment device or to at least provide the public or industry with a useful choice.

SUMMARY

According to one example embodiment there is provided an underwater device comprising:

a device body, having a center; and at least one buoyancy adjusting device, each at least one buoyancy adjusting device comprising:

a tube having first and second ends;

a resilient mechanism located at the first end of the tube and extending towards the second end of the tube;

an opening near the second end of the tube;

a catch at the second end of the tube; and at least one block insertable into the tube from the first end of the tube to adjust the buoyancy.

Alternatively, the resilient mechanism is a spring.

Preferably the spring is a coil spring.

Preferably at least one of the at least one blocks is negatively buoyant.

Alternatively, at least one of the at least one blocks is positively buoyant.

Preferably at least one of the at least one blocks is a weight.

Preferably the weight is a washer.

Alternatively, at least one of the at least one blocks is a float.

Preferably the float is made of syntactic foam.

Preferably wherein the float is a hollow sealed cylinder.

Preferably the hollow sealed cylinder is made of aluminum.

Preferably the buoyancy adjusting device further including a cap to close the open first end of the tube.

Preferably the cap is neutrally buoyant.

Alternatively, the cap is negatively buoyant. Alternatively, the cap is positively buoyant.

Preferably the first end of the tube is threaded, and the cap is threaded and the cap screws onto the first end of the tube.

Preferably the underwater device is an underwater vehicle.

According to another example embodiment there is provided an underwater device comprising:

an underwater device body, having a center; and at least one buoyancy adjusting device described above.

Preferably the at least one buoyancy adjusting device is at least two devices.

Preferably the at least one buoyancy adjusting devices are offset from the vertical and horizontal relative to the center of the device; and the number of buoyancy adjusting devices is eight.

Preferably the underwater device is an underwater vehicle.

It is acknowledged that the terms "comprise", "comprises" and "comprising" may, under varying jurisdictions, be attributed with either an exclusive or an inclusive meaning. For the purpose of this specification, and unless otherwise noted, these terms are intended to have an inclusive meaning— i.e., they will be taken to mean an inclusion of the listed components which the use directly references, and possibly also of other non-specified components or elements.

Reference to any document in this specification does not constitute an admission that it is prior art, validly combinable with other documents or that it forms part of the common general knowledge.

BRIEF DESCRIPTION OF THE DRAWINGS

The accompanying drawings which are incorporated in and constitute part of the specification, illustrate embodiments of the invention and, together with the general description of the invention given above, and the detailed description of embodiments given below, serve to explain the principles of the invention, in which.

DETAILED DESCRIPTION

Figure 1:
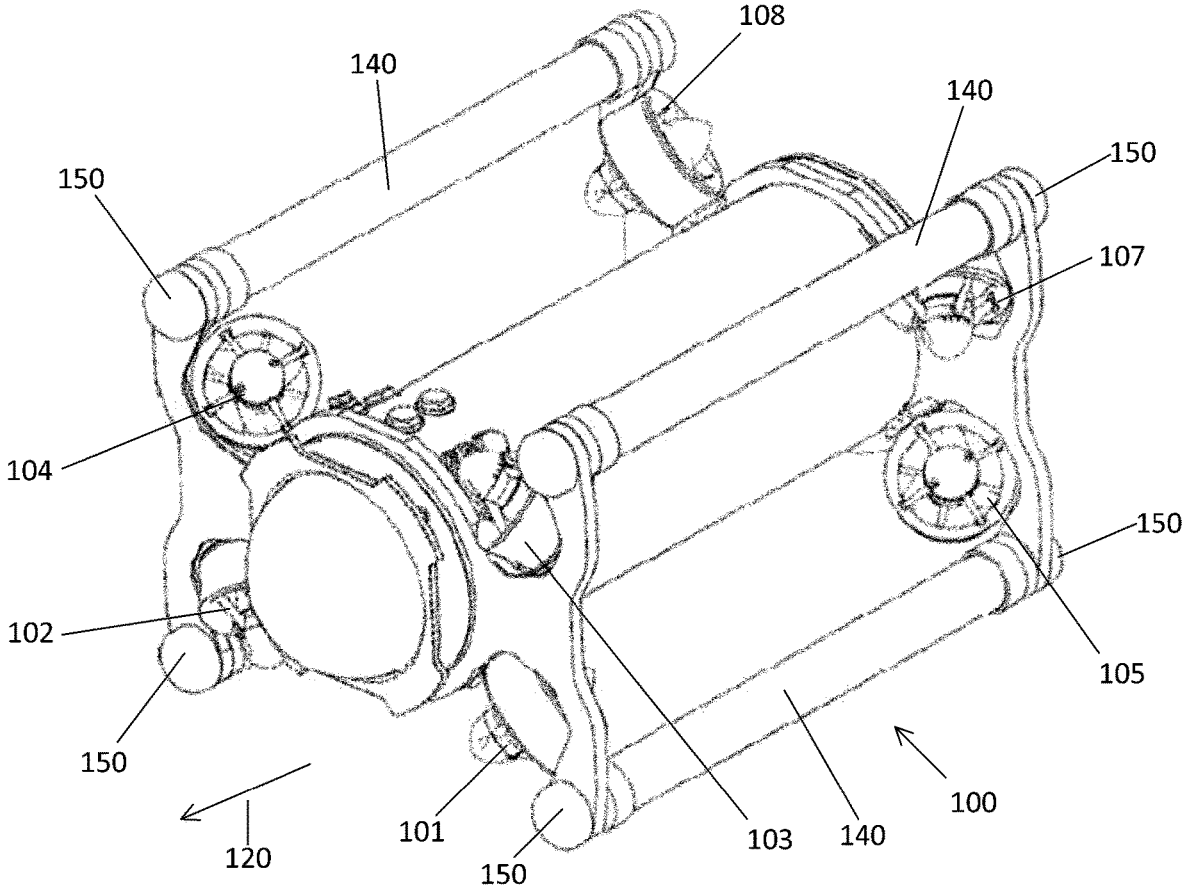
FIG. 1 is an isometric view of the vehicle of an example embodiment.

FIG. 1 illustrates an ROVs underwater device according to an example embodiment. The underwater device 100 in one embodiment contains thrusters 101-108 in the corners of an open rectangular design. The thrusters in this configuration allow independent adjustment of the three rotational axes (roll, pitch, and yaw), and the three translational axes being x/longitudinal/surge; y/lateral/sway; and z/vertical/heave.

Figure 2:
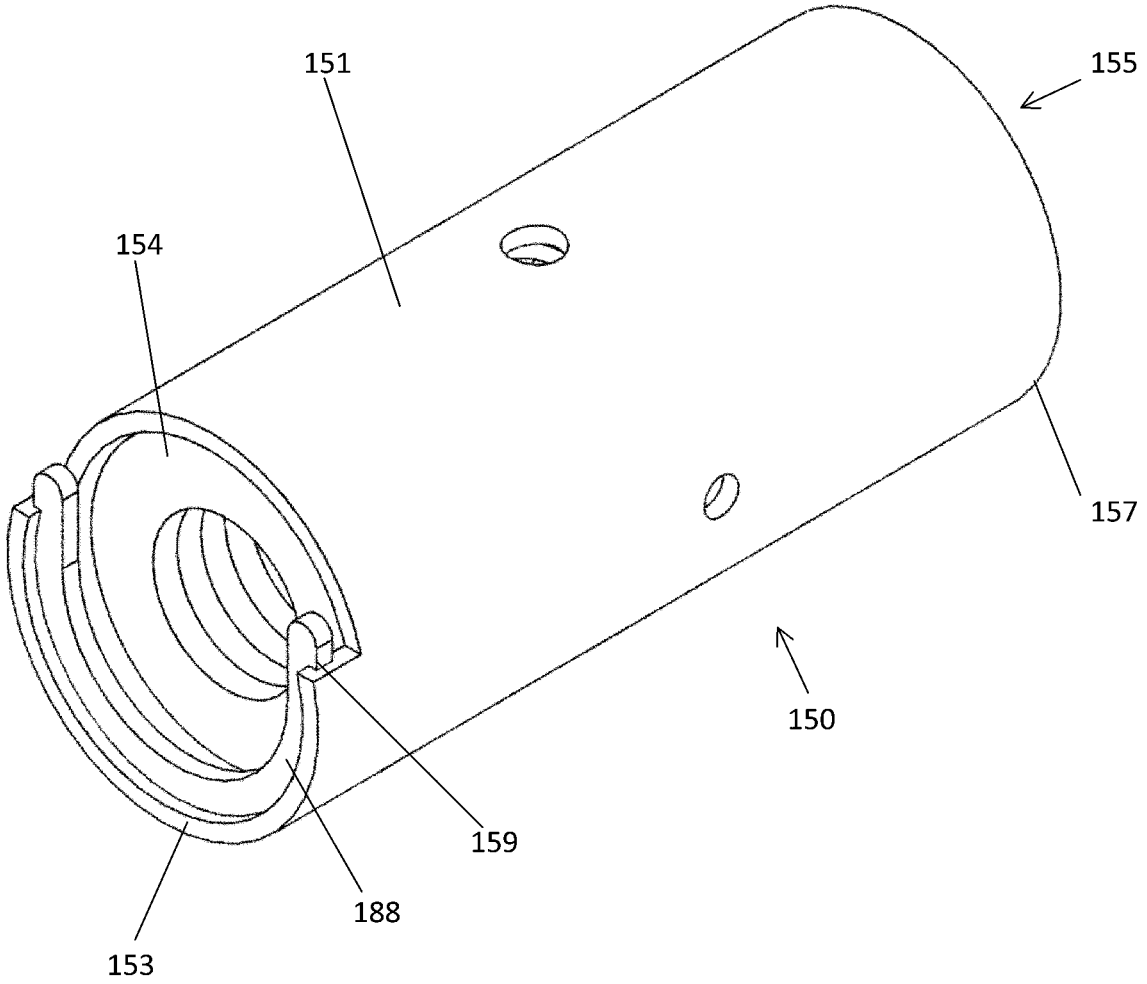
FIG. 2 is a view of an example embodiment of the buoyancy adjusting device.

The underwater device 100 contains buoyancy adjusting devices 150 in each of the corners of the underwater device 100. Alternatively, double ended buoyancy adjusting devices illustrated in FIGS. 4 and 5 could extend along the length of the tubes 140 on four parallel edges. The buoyancy adjusting devices 150 in this configuration allow control of the buoyancy in the three rotational axes (roll, pitch, and yaw). The buoyancy adjusting devices 150 are shown in FIG. 2 and in the example, embodiment is a tube 151 having first end 155 and second end 153. While illustrated as a circular tube other cross sections including oval, square or rectangle could equally be used.

The underwater device may be a remotely operated vehicles or ROVs for use underwater, autonomous underwater vehicles or AUVs, drop cameras for use underwater and/or towed cameras for use underwater.

Figure 3:
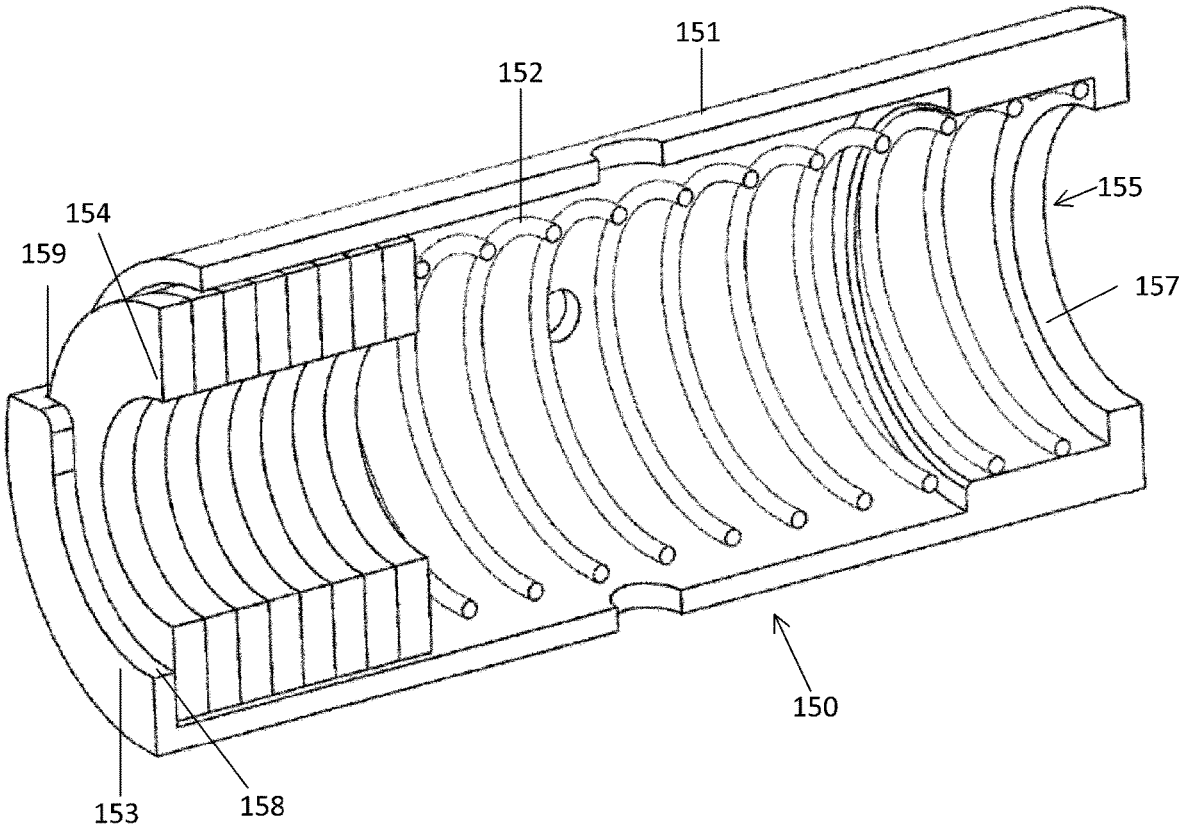
FIG. 3 is a cross section of an example buoyancy adjusting device.

Referring to FIG. 3 a resilient mechanism 152 shown as a spring extends from a stop 157 at the first end 155 of the tube 151 and extends towards the second end 153 of the tube 151. At the second end 153 of the tub 151 a second stop 158 is located. While the resilient mechanism 152 is illustrated as a coil spring, other mechanisms could be used, for example an elastic member.

An opening 159 near the second end 153 of the tube 151 allows blocks 154 to be inserted into the tube 151. A catch or lip 158 at the second end 153 of the tube secures blocks 154 in the tube. A permanent lip 158 is shown in FIGS. 3, 4 and 5 while a circlip 188 insertable into a groove is illustrated in FIG. 2

Other securing mechanisms that allow for a block 154 to be inserted into the tube 151 could also be used. As a block 154 is inserted into the tube 151 the resilient mechanism 152 is compressed creating space in the tube 151 for the block 154. The force of the resilient mechanism 152 acting on the block or blocks 154 pushes the blocks against the catch or lip 158 that substantially prevents movement of the blocks 154.

Figure 4:
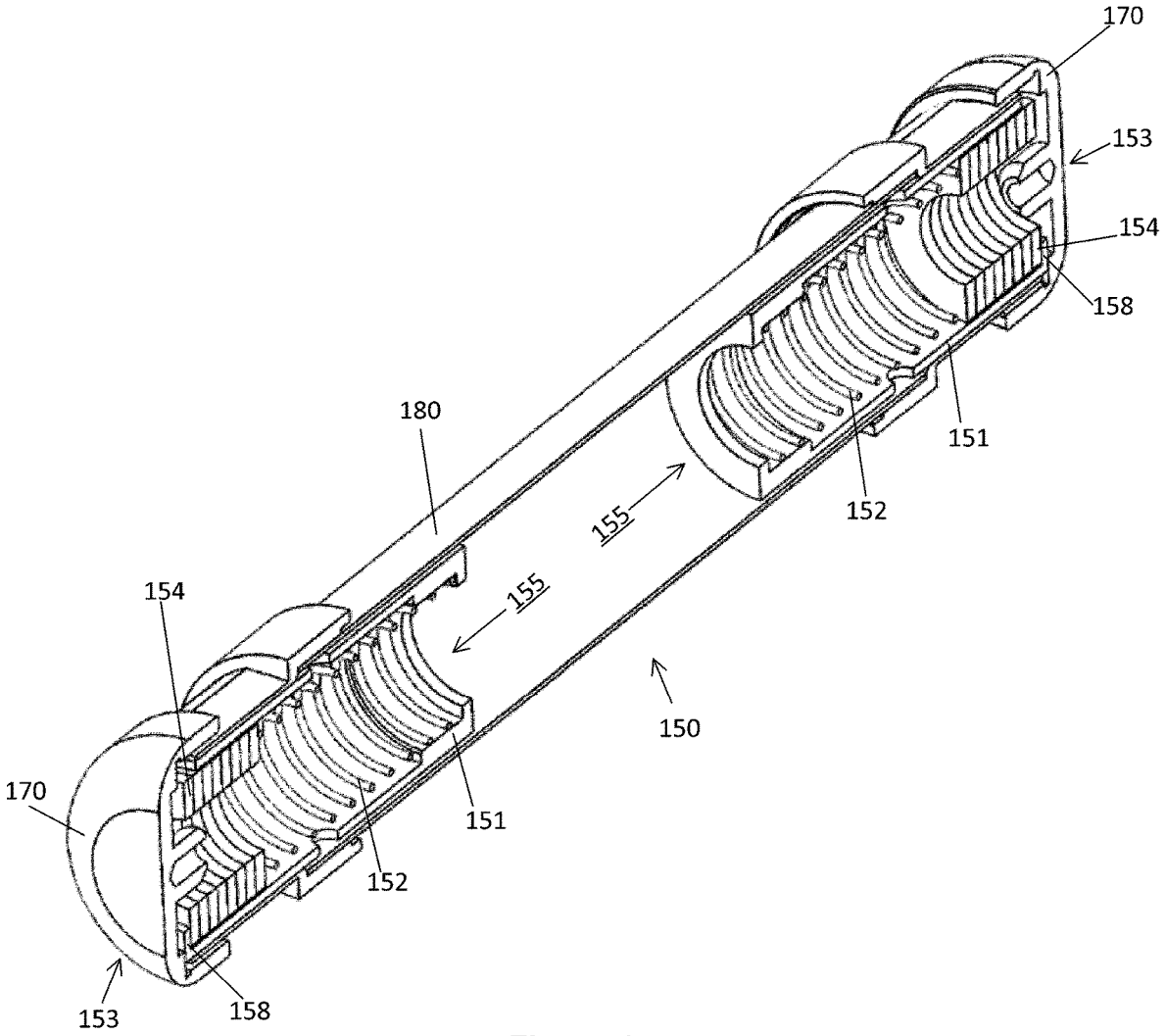
FIG. 4 is cross section of a further example buoyancy adjusting device.
Figure 5:
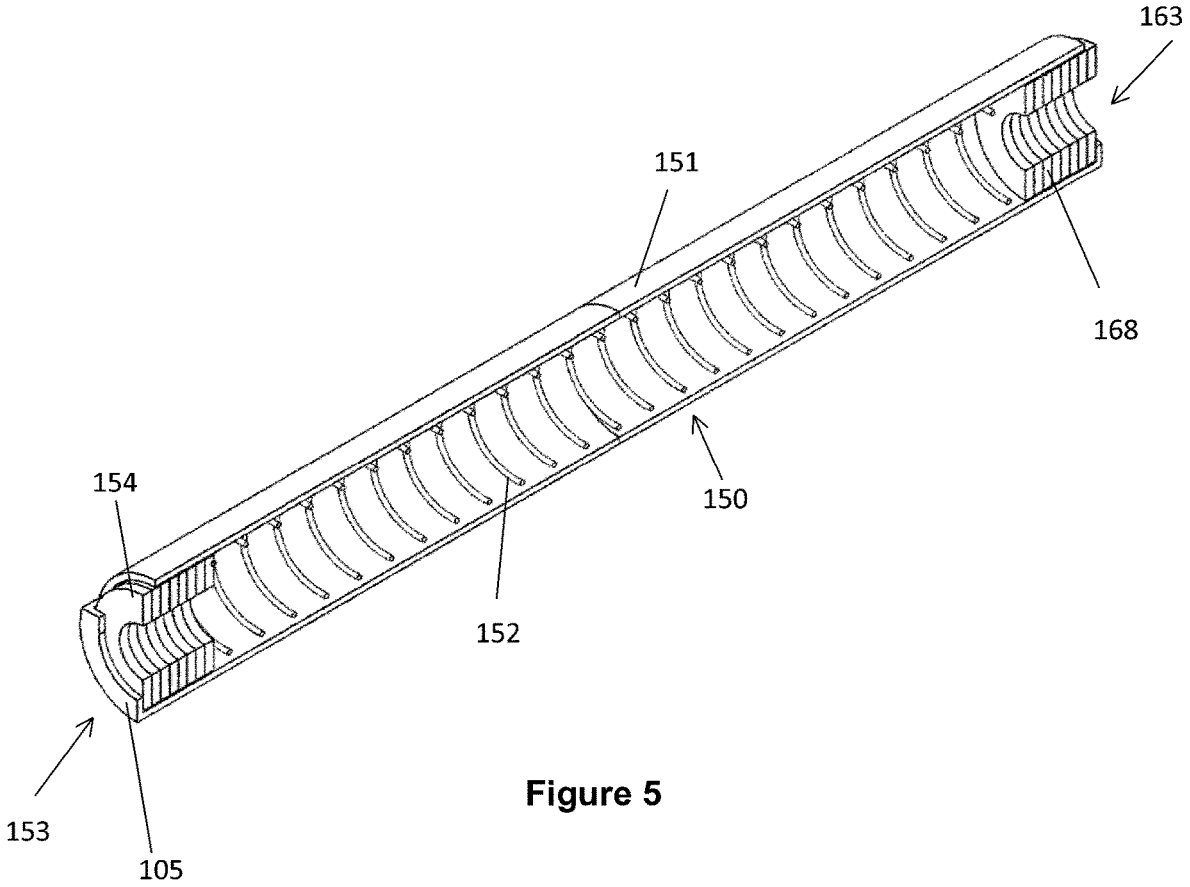
FIG. 5 is a cross section of yet a further example buoyancy adjusting device.

A cap 170 shown in FIGS. 1 and 4 is screwed or clipped onto the open end or ends of buoyancy adjusting devices 150 once adjustment of the underwater device 100 buoyancy has been made The blocks 154 may be negatively buoyant or positively buoyant. Negatively buoyant blocks could be weights for example a metal washer. Positively buoyant blocks may be a float made for example of syntactic foam. Alternatively, the float could be a lightweight hollow sealed cylinder made of aluminum or other suitable material.

The cap 170 is typically neutrally buoyant. However negatively buoyant and or positively buoyant caps could be produced. A user moving an AUV/ROV from fresh water to salt water without making any other changes could swap neutrally buoyant caps for suitable negatively buoyant caps. When moving from salt water to fresh water could swap neutrally buoyant caps for suitable positively buoyant caps.

Typically, one buoyancy device 150 would be used for each corner of an underwater device however any suitable number could be used for example three devices in a triangle arrangement on the bottom of a AUV/ROV that this designed to be negatively buoyant at the bottom of the underwater device. As discussed above a double end buoyancy adjusting device 150 illustrated in FIGS. 4 and 5 could be located on four parallel edges to provide for the same adjustability.

Any number of buoyancy adjusting devices could be used for example with a drop camera or towed camera a single buoyancy adjusting device could be used.

Referring to FIG. 4 two of the buoyancy adjusting device tubes 151 are fitting into an outer tube 180 such that a double open-ended buoyancy device is created. Blocks 154 may be inserted into the tubes 151 from either end of the outer tube 180.

FIG. 5 illustrates a further embodiment of a double ended buoyancy adjusting device 150 is illustrated. The tube 151 is open at both ends 153, 163. Catches 158, 168 are located at both ends 153, 163 of the tube 151 and a resilient mechanism 152, typically a coil spring extends between the two ends 153, 163. Blocks 154 may be inserted into the tube 151 from either end 153, 163 and the resilient mechanism 152 is compressed creating space in the tube 151 for the blocks 154.

While the present invention has been illustrated by the description of the embodiments thereof, and while the embodiments have been described in detail, it is not the intention of the Applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departure from the spirit or scope of the Applicant's general inventive concept.

The invention claimed is:

1. An underwater device comprising:
a device body, having a center; and
at least one buoyancy adjusting device, each at least one buoyancy adjusting device comprising:
a tube having first and second ends;
a resilient mechanism located at the first end of the tube and extending towards the second end of the tube;
an opening near the second end of the tube
a catch at the second end of the tube; and
at least one block insertable into the tube from the second end of the tube to adjust the buoyancy.

2. The underwater device of claim 1 further including:
an opening near the first end of the tube; and
a catch at the first end of the tube,
wherein at least one of the at least one block is insertable into the tube from the first end of the tube to adjust the buoyancy.

3. The underwater device of claim 1 wherein the resilient mechanism is a spring.

4. The underwater device of claim 3 wherein the spring is a coil spring.

5. The underwater device of claim 1 wherein at least one of the at least one blocks is negatively buoyant.

6. The underwater device of claim 5 wherein at least one of the at least one blocks is a weight.

7. The underwater device of claim 6 wherein the weight is a washer.

8. The underwater device of claim 1 wherein at least one of the at least one blocks is positively buoyant.

9. The underwater device of claim 8 wherein at least one of the at least one blocks is a float.

10. The underwater device of claim 9 wherein the float is made of syntactic foam.

11. The underwater device of claim 9 wherein the float is a hollow sealed cylinder.

12. The underwater device of claim 11 wherein the hollow sealed cylinder is made of aluminum.

13. The underwater device of claim 1 further including a cap to close the open second end of the tube.

14. The underwater device of claim 13 wherein the cap is neutrally buoyant.

15. The underwater device of claim 13 wherein the cap is negatively buoyant.

16. The underwater device of claim 13 wherein the cap is positively buoyant.

17. The underwater device of claim 1 wherein the second end of the tube is threaded, and the cap is threaded and the cap screws onto the second end of the tube.

18. The underwater device of claim 1 wherein the underwater device is an underwater vehicle.

19. The underwater device of claim 18 where the at least one buoyancy adjusting device is at least two devices.

20. The underwater device of claim 18 where the at least one buoyancy adjusting device are offset from the vertical and horizontal relative to the center of the underwater device; and the number of buoyancy adjusting devices is eight.

* * * * *